US006796100B1

(12) United States Patent
Venezia

(10) Patent No.: US 6,796,100 B1
(45) Date of Patent: Sep. 28, 2004

(54) ROOF VENTING AND COVER ASSEMBLY

(76) Inventor: Dominick Venezia, 677 Prospect Ave., Fairview, NJ (US) 07022

( * ) Notice: Subject to any disclaimer, the term of this patent is extended or adjusted under 35 U.S.C. 154(b) by 0 days.

(21) Appl. No.: 10/015,300

(22) Filed: Dec. 12, 2001

(51) Int. Cl.[7] ..... F24F 7/02

(52) U.S. Cl. ..... 52/741.1; 52/302.1; 52/741.3; 52/199; 52/95; 454/358; 454/367

(58) Field of Search ..... 52/94, 95, 200, 52/244, 199, 741.1, 741.3, 302.1; 454/354, 355, 367, 358

(56) References Cited

U.S. PATENT DOCUMENTS 4,214,511 A * 7/1980 Mueller ..... 98/37
4,480,534 A * 11/1984 Sloan ..... 98/55
4,520,959 A * 6/1985 Kolt ..... 236/49.5
5,330,386 A * 7/1994 Calandra ..... 454/341
5,502,935 A * 4/1996 Demmer ..... 52/200
5,711,091 A * 1/1998 Bos ..... 34/606
5,815,996 A * 10/1998 Granger ..... 52/202
5,947,816 A * 9/1999 Schiedegger et al. ..... 454/339
6,149,516 A * 11/2000 Mantyla ..... 454/359
6,219,977 B1 * 4/2001 Chao et al. ..... 52/200
6,484,459 B1 * 11/2002 Platts ..... 52/219
6,487,826 B1 * 12/2002 McCorsley et al. ..... 52/408

* cited by examiner

*Primary Examiner*—Brian E. Glessner
(74) *Attorney, Agent, or Firm*—Goldstein Law Offices, P.C.

(57) ABSTRACT

A roof venting and cover assembly including a housing dimensioned for being positioned between an opening in a roof and an opening in a soffit disposed below the roof. The housing includes a narrow upper duct portion and a wide lower scoop portion. The narrow upper duct portion has an open upper end disposed within the opening in the roof. The wide lower scoop portion has an open lower end disposed within the opening in the soffit. A cover member is openably secured over the open upper end of the narrow upper duct portion of the housing.

2 Claims, 3 Drawing Sheets

ROOF VENTING AND COVER ASSEMBLY

BACKGROUND OF THE INVENTION

The present invention relates to a roof venting and cover assembly and more particularly pertains to relieving pressure on a roof soffit.

The use of ventilation systems is known in the prior art. More specifically, ventilation systems heretofore devised and utilized for the purpose of providing adequate ventilation are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,918,425 to Archard discloses a vent and channel assembly for preventing undesirable wind from entering the space between the joists and rafters of a building. U.S. Pat. No. 5,569,158 to Norton discloses a vent passage formed in the soffit of a building to permit airflow. U.S. Pat. No. 5,195,283 to MacLeod discloses a combined soffit vent and bracket for holding the device below the eve of a building.

While these devices fulfill their respective, particular objective and requirements, the aforementioned patents do not describe a roof venting and cover assembly for relieving pressure on a roof soffit.

In this respect, the roof venting and cover assembly according to the present invention substantially departs from the conventional concepts and designs of the prior art, and in doing so provides an apparatus primarily developed for the purpose of relieving pressure on a roof soffit.

Therefore, it can be appreciated that there exists a continuing need for a new and improved roof venting and cover assembly which can be used for relieving pressure on a roof soffit. In this regard, the present invention substantially fulfills this need.

SUMMARY OF THE INVENTION

In the view of the foregoing disadvantages inherent in the known types of ventilation systems now present in the prior art, the present invention provides an improved roof venting and cover assembly. As such, the general purpose of the present invention, which will be described subsequently in greater detail, is to provide a new and improved roof venting and cover assembly which has all the advantages of the prior art and none of the disadvantages.

To attain this, the present invention essentially comprises a housing dimensioned for being positioned between an opening in a roof and an opening in a soffit disposed below the roof. The housing includes a narrow upper duct portion and a wide lower scoop portion. The narrow upper duct portion has an open upper end disposed within the opening in the roof. The wide lower scoop portion has an open lower end disposed within the opening in the soffit. A ventilation grate is secured over the open lower end of the wide lower scoop portion of the housing. A cover member is secured over the open upper end of the narrow upper duct portion of the housing. The cover member includes a peripheral frame disposed around the open upper end of the narrow upper duct portion. The peripheral frame includes a raised peripheral lip extending upwardly from an inner edge thereof. The cover member includes an openable lid hingedly coupled with the raised peripheral lip.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved roof venting and cover assembly which has all the advantages of the prior art ventilation systems and none of the disadvantages.

It is another object of the present invention to provide a new and improved roof venting and cover assembly which may be easily and efficiently manufactured and marketed.

It is a further object of the present invention to provide a new and improved roof venting and cover assembly which is of durable and reliable construction.

An even further object of the present invention is to provide a new and improved roof venting and cover assembly which is susceptible of a low cost of manufacture with regard to both materials and labor, and which accordingly is then susceptible of low prices of sale to the consuming public, thereby making such a roof venting and cover assembly economically available to the buying public.

Even still another object of the present invention is to provide a new and improved roof venting and cover assembly for relieving pressure on a roof soffit.

Lastly, it is an object of the present invention to provide a new and improved roof venting and cover assembly including a housing dimensioned for being positioned between an opening in a roof and an opening in a soffit disposed below the roof. The housing includes a narrow upper duct portion and a wide lower scoop portion. The narrow upper duct portion has an open upper end disposed within the opening in the roof. The wide lower scoop portion has an open lower end disposed within the opening in the soffit. A cover member is openably secured over the open upper end of the narrow upper duct portion of the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
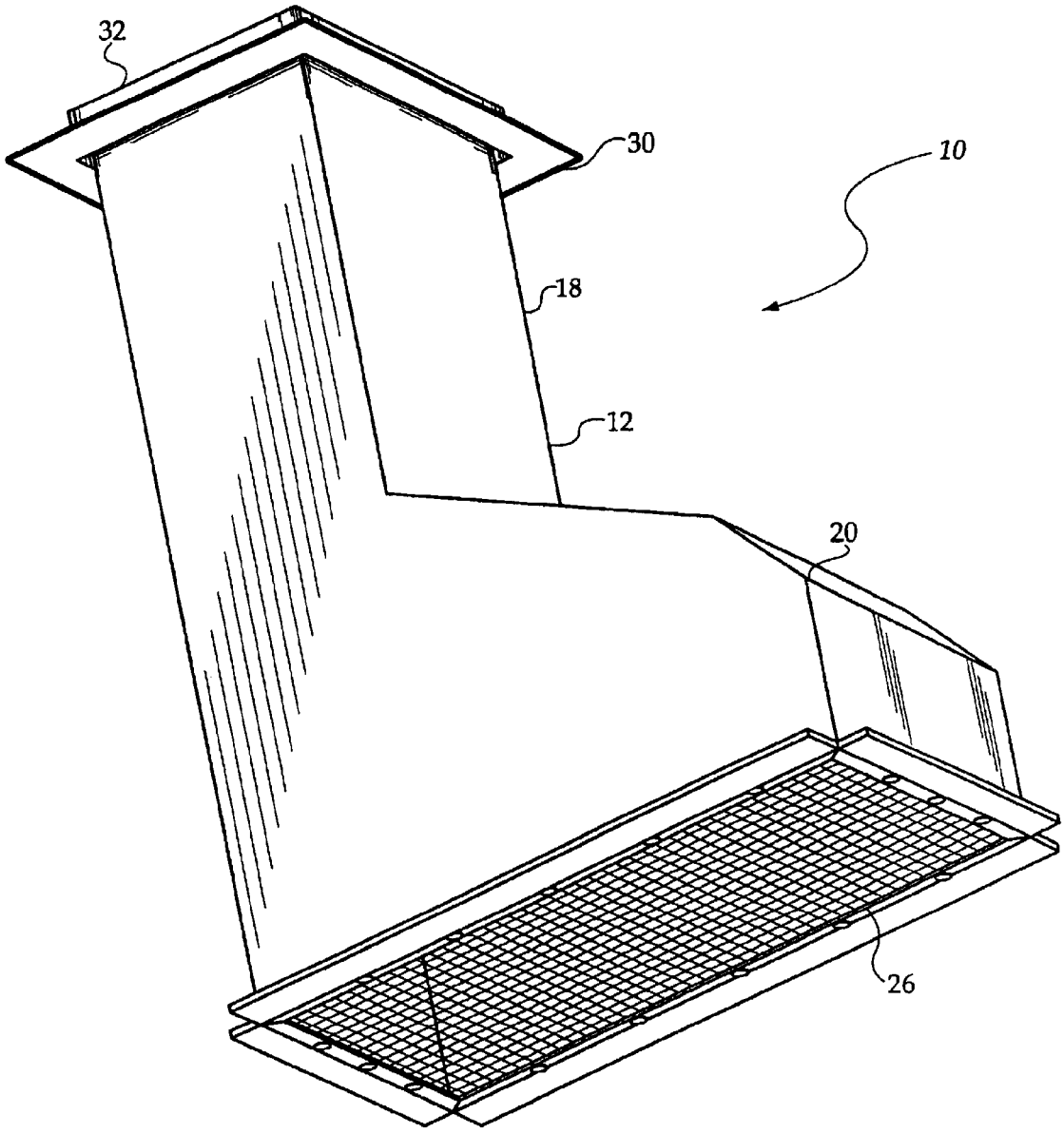
FIG. 1 is a perspective view of the preferred embodiment of the roof venting and cover assembly constructed in accordance with the principles of the present invention.
Figure 2:
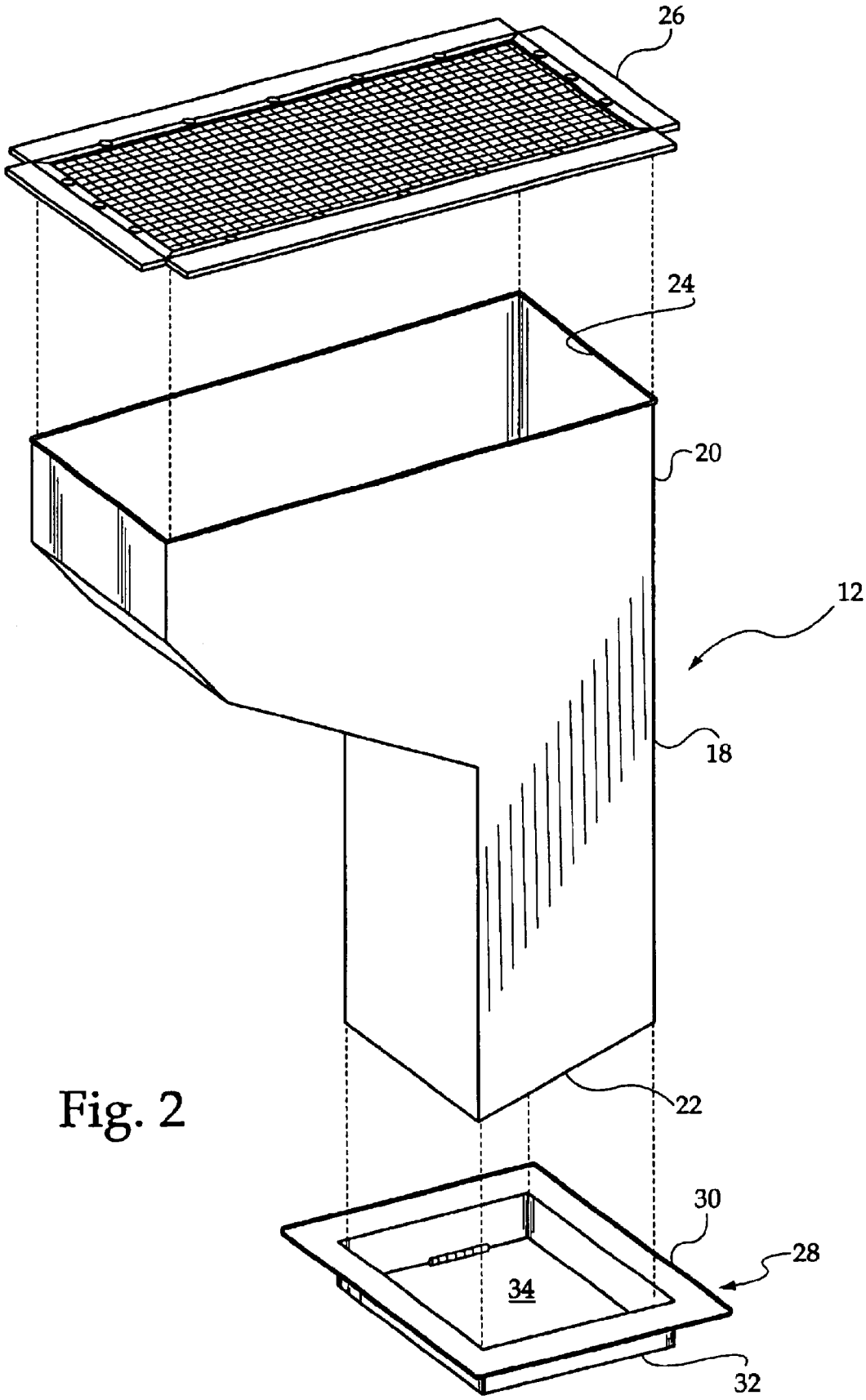
FIG. 2 is an exploded perspective view of the present invention.
Figure 3:
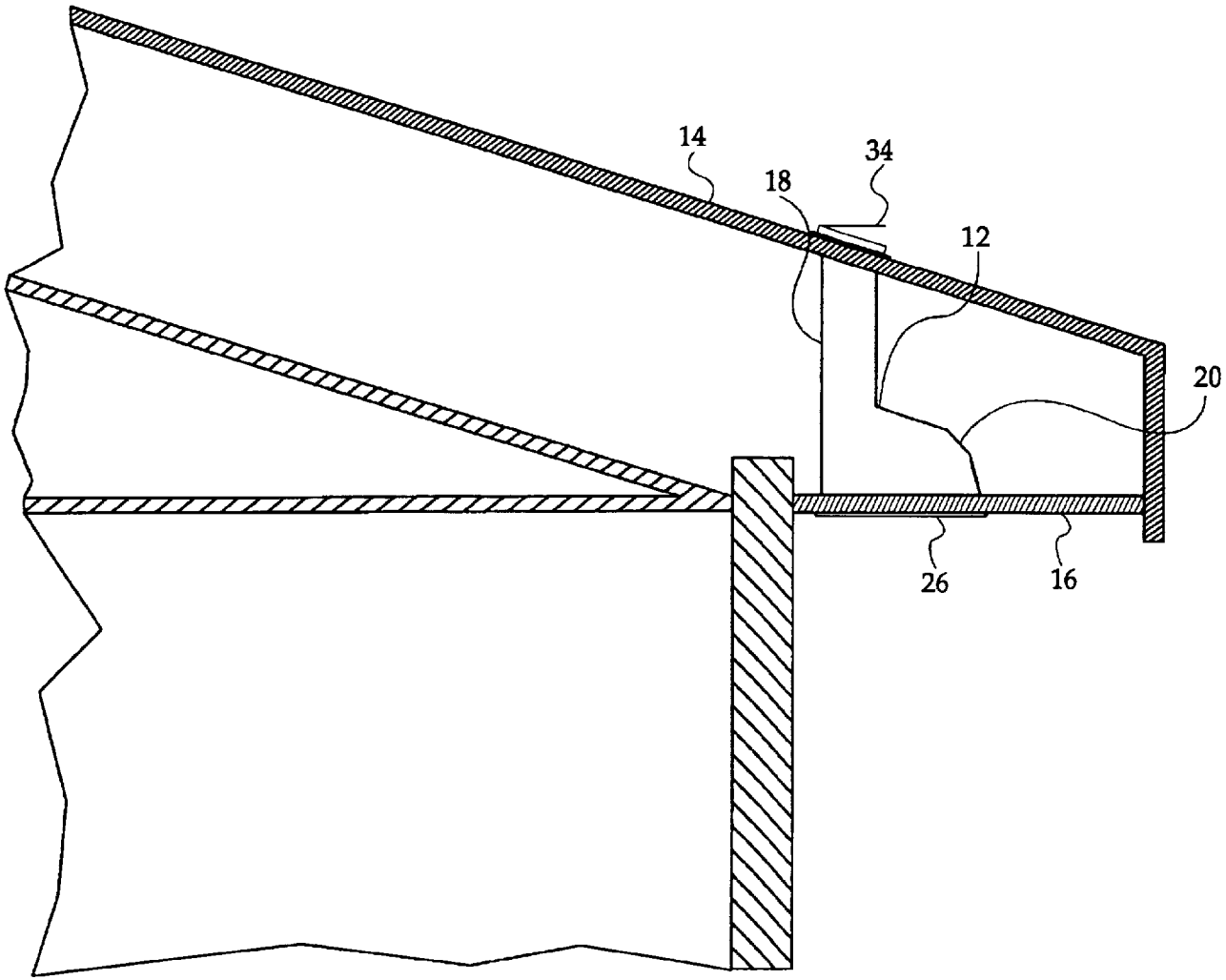
FIG. 3 is a side view of the present invention illustrated in use.

With reference now to the drawings, and in particular, to FIGS. 1 through 3 thereof, the preferred embodiment of the new and improved roof venting and cover assembly embodying the principles and concepts of the present invention and generally designated by the reference number 10 will be described.

Specifically, it will be noted in the various Figures that the device relates to a roof venting and cover assembly for relieving pressure on a roof soffit. In its broadest context, the device consists of a housing, a ventilation grate, and a cover member. Such components are individually configured and correlated with respect to each other so as to attain the desired objective.

The housing 12 is dimensioned for being positioned between an opening in a roof 14 and an opening in a soffit 16 disposed below the roof 14. The housing 12 includes a narrow upper duct portion 18 and a wide lower scoop portion 20. The narrow upper duct portion 18 has an open upper end 22 disposed within the opening in the roof 14. The wide lower scoop portion 20 has an open lower end 24 disposed within the opening in the soffit 14.

The ventilation grate 26 is secured over the open lower end 24 of the wide lower scoop portion 20 of the housing 12. The grate 26 will prevent access to the housing 12 while allowing the flow of air through the housing 12.

The cover member 28 is secured over the open upper end 22 of the narrow upper duct portion 18 of the housing 12. The cover member 28 includes a peripheral frame 30 disposed around the open upper end 22 of the narrow upper duct portion 18. The peripheral frame 30 includes a raised peripheral lip 32 extending upwardly from an inner edge thereof. The cover member 28 includes an openable lid 34 hingedly coupled with the raised peripheral lip 32.

The present invention is designed to allow strong and destructive winds, normally associated with hurricanes, to pass through the roof 14. This will reduce the pressure caused by the winds on the roof 14 and exterior walls of the dwelling. The present invention will automatically operate once high winds commence. The winds will cause the openable lid 34 to open thereby exposing the open upper end 22 of the duct portion 18 of the housing 12. Once the lid 34 is opened, the winds will be channeled downwardly through the housing 12 thereby reducing the exposure of the roof 14. The assembly may be utilized on various roof types, namely flat roofs or pitched roofs.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed is:

1. A venting method for relieving pressure on a soffit positioned below a roof, the soffit having an exterior, the roof having an exterior, the method using an assembly positioned between an opening in the roof and a soffit, the assembly comprising a housing, a ventilation grate and a cover member, the housing having a narrow upper duct portion and a wide lower scoop portion, the upper duct portion having an open upper end disposed within the opening in the roof, the lower scoop portion having an open lower end disposed within an opening in the soffit, the ventilation grate being secured over the open lower end of the lower scoop portion, the cover member having an openable lid, the cover member being secured over the open upper end of the upper duct portion, the method comprising the iterative steps of:

venting winds between the soffit exterior and the roof exterior by allowing air to travel between the soffit and the roof through the housing by entering and exiting through the ventilation grate and the open upper end.

2. The venting method as recited in claim 1, further comprising the step of covering the open upper end with the lid, and wherein the step of venting further comprises opening the lid by the winds.

* * * * *